US010517359B2

(12) United States Patent
Rodriguez

(10) Patent No.: US 10,517,359 B2
(45) Date of Patent: Dec. 31, 2019

(54) MOTION ACTIVATED ILLUMINATED BRACELET

(71) Applicant: Daniel Rodriguez, Camuy, PR (US)

(72) Inventor: Daniel Rodriguez, Camuy, PR (US)

(73) Assignee: Ellen Rodriguez, Camuy, PR (US)

( * ) Notice: Subject to any disclaimer, the term of this patent is extended or adjusted under 35 U.S.C. 154(b) by 0 days.

(21) Appl. No.: 16/221,119

(22) Filed: Dec. 14, 2018

(65) Prior Publication Data

US 2019/0191831 A1 Jun. 27, 2019

Related U.S. Application Data

(60) Provisional application No. 62/598,764, filed on Dec. 14, 2017.

(51) Int. Cl.
*A44C 15/00* (2006.01)
*A44C 5/00* (2006.01)

(52) U.S. Cl.
CPC ..... *A44C 15/0015* (2013.01); *A44C 5/0007* (2013.01); *A44C 5/0084* (2013.01)

(58) Field of Classification Search
CPC ..... A44C 5/00–5/246; A44C 15/0015; F21V 33/008; F21V 33/0008; F21V 33/0004; A63B 2207/02; A63B 21/0608
See application file for complete search history.

(56) References Cited

U.S. PATENT DOCUMENTS 3,509,660 A * 5/1970 Seymour ..... A63B 19/00 446/38
4,006,556 A * 2/1977 Williams ..... A63B 19/00 446/242
4,915,666 A * 4/1990 Maleyko ..... A63B 19/00 446/242
5,839,814 A 11/1998 Roberts
5,934,784 A * 8/1999 Dion ..... A43B 1/0036 362/103
8,342,901 B1 * 1/2013 Deluz ..... A63B 19/00 446/175
8,769,986 B1 * 7/2014 DiPietro ..... A44C 5/0092 63/3.1
2015/0189403 A1 * 7/2015 Magi ..... H04Q 9/00 340/870.07
2016/0374439 A1 * 12/2016 Jacobs ..... A44C 5/0007 63/1.13

* cited by examiner

*Primary Examiner* — Mariceli Santiago
(74) *Attorney, Agent, or Firm* — Jason T. Daniel, Esq.; Daniel Law Offices, P.A.

(57) ABSTRACT

A motion activated illuminated bracelet includes a circular shaped main body having an inside diameter that is suitable for being worn about the wrist of a user. A plurality of illuminating charms is positioned equidistantly along the main body and include a power source, a switch and a light. A plurality of audible charms is positioned equidistantly along the main body and include a power source, a switch and a speaker. A plurality of decorative charms is positioned equidistantly along the main body and include a housing having any number of decorative elements, and a weight that is complementary to the weight of an audible charm or an illuminating charm. Each of the illuminating charms and the audible charms are selectively activated by a centrifugal force associated with the rotation of the bracelet, and some of the illuminated charms are connected to the main body via a resilient tether.

15 Claims, 4 Drawing Sheets

MOTION ACTIVATED ILLUMINATED BRACELET

CROSS-REFERENCE TO RELATED APPLICATIONS

This application claims the benefit of U.S. Application Ser. No. 62/598,764 filed on Dec. 14, 2017, the contents of which are incorporated herein by reference.

TECHNICAL FIELD

The present invention relates generally to toys, and more particularly to a wearable toy that illuminates when receiving a centrifugal force.

BACKGROUND

The statements in this section merely provide background information related to the present disclosure and may not constitute prior art.

Toys having lights and/or sound are extremely popular with children of all ages and abilities. In recent years, there has been a trend toward manufacturing small toys that children can take with them when traveling. Unfortunately, the small size of these toys often results in the child losing the toy, and the parent having to purchase a replacement.

Accordingly, it is desirable to provide a toy for amusing a user that can be worn by the user when not in use.

SUMMARY OF THE INVENTION

The present invention is directed to a motion activated illuminated bracelet. One embodiment of the present invention can include a circular shaped main body having an inside diameter that is suitable for being worn about the wrist of a user. The main body may be constructed from a rigid material such as plastic so as to maintain a circular shape when spinning or may be constructed from a malleable material so as to morph into different shapes when spinning.

In one embodiment, a plurality of illuminating charms can be positioned equidistantly along the main body. Each of the illuminating charms can include a power source, a switch and a light, and can be activated by the centrifugal force of the bracelet spinning about the finger of a user. In one embodiment, a plurality of audible charms can be positioned equidistantly along the main body. Each of the audible charms can include a power source, a switch and a speaker, and can be activated by the centrifugal force of the bracelet spinning about the finger of a user.

In one embodiment, a plurality of decorative charms can be positioned equidistantly along the main body. Each of the decorative charms can include a housing having any number of decorative elements and can include a weight that is complementary to the weight of an audible charm or an illuminating charm. In one embodiment, a plurality of resilient tethers can be interposed between some of the plurality of illuminated charms and the bracelet body; the resilient tethers functioning to expand and contract with the centrifugal force.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
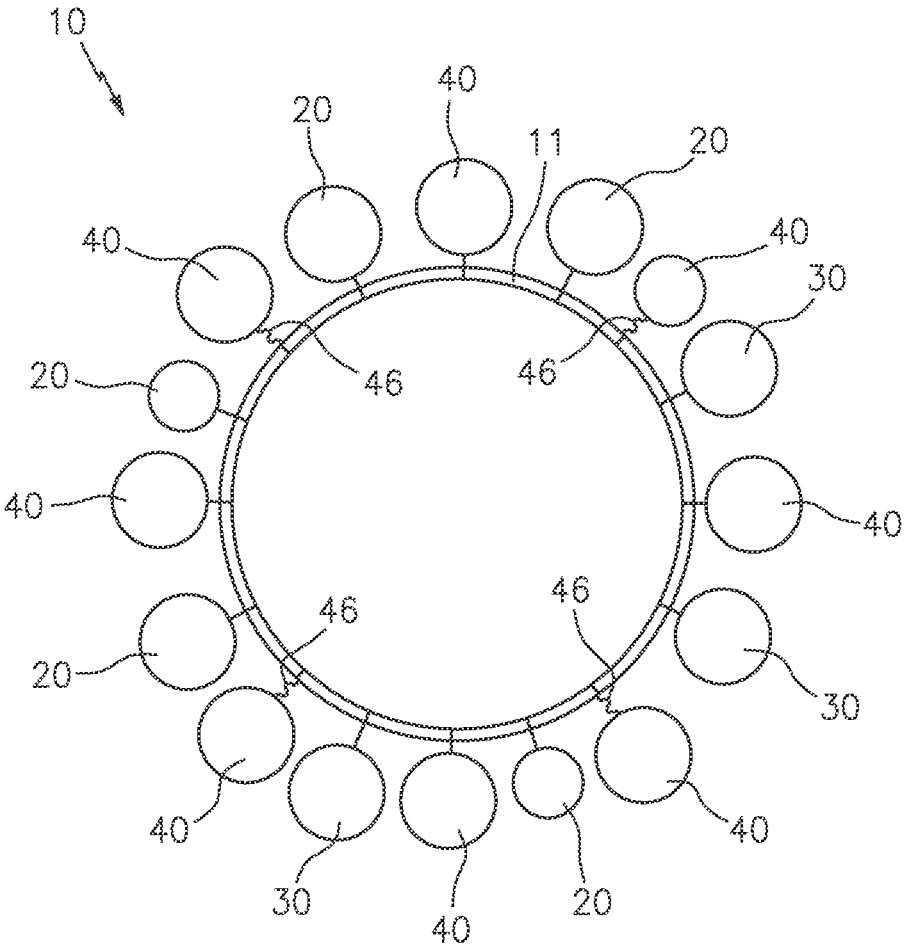
FIG. 1 is a top view of a motion activated illuminated bracelet that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein. However, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical, to the shape and size of another identified component. As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

FIGS. 1-5B illustrate one embodiment of a motion activated illuminated bracelet 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, the device 10 can include a main body 11 having a plurality of decorative charms 20, audible charms 30, and illuminating charms 40 secured thereon.

The main body 11 can function to receive and support each of the below described charms and can include a circular shape so as to be capable of being worn about the wrist of a user when not in active operation. In one embodiment, the main body 11 can be constructed from a rigid material such as various plastics, metals, or composites, for example, so as to maintain a circular shape when stationary or spinning. The main body can include an inside diameter of between 2 and 4 inches, which is suitable for receiving the hand and wrist of most individuals. Of course, many other dimensions are also contemplated. In another embodiment, the main body can be constructed from a malleable and/or elastomeric material such nylon or rubber, for example, so as to be able to change shapes and sizes when stationary or while spinning.

In the preferred embodiment, the plurality of charms 20, 30 and 40 will be arranged along the entirety of the main body, so as to evenly distribute the weight and mass of the device.

Figure 2:
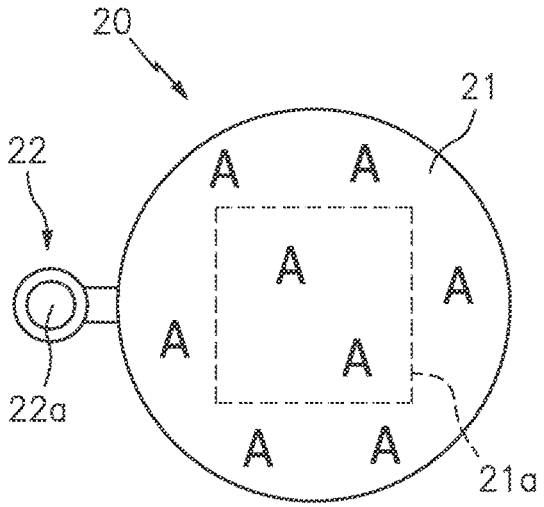
FIG. 2 is a top view of a decorative charm of the illuminated bracelet, in accordance with one embodiment of the invention.

As shown best in FIG. 2, each of the plurality of charms 20, 30 and 40 can include a housing 21 and an attachment ring 22.

As described herein, the housing 21 can include any number of different shapes and sizes and can be constructed from any number of different materials suitable for encompassing charm circuitry in a watertight manner. In one preferred embodiment, the housing 21 can be constructed from translucent and colored molded plastic; however, any number of other known construction materials such as PVC, and composites, for example, are also contemplated.

In the preferred embodiment, each of the charms 20 can include a central mass 21*a* that is located within the housing 21. The central mass preferably being constructed from the same material as the housing and functioning to replicate the weight of the circuitry of the below described audible and illuminating charms. Such a feature ensuring that a user will be able to spin/rotate the device about their finger in a smooth and continuous motion, as described below.

Each of the charm housings can be constructed to include any number and type of decorative elements A such as various colors, markings, words, shapes, symbols, logos, designs, textures, patterns, images, and/or jewels, for example. These elements can be secured onto and/or into the housing body in accordance with known techniques so as to be flush with the surface of the main body or can be recessed, raised and/or protruding outward from the housing body so as to give a three-dimensional effect.

The attachment ring 22 can act to secure the housing 21 onto the main body 11. In the preferred embodiment, the attachment ring can preferably include a loop that is integrally formed into the housing 21 and includes an opening 22*a* through which the main body material can pass. In various embodiments, the opening can be sized larger than the diameter of the main body material so as to allow the housing to move along the length of the main body 11. In other embodiments, the opening can be sized complementary to the diameter of the main body material so as to prevent movement of the housing along the main body.

Although described above as including a loop that is positioned along one side of the main body, this is for illustrative purposes only. To this end, the attachment ring can be positioned anywhere along the housing 21, and can include, comprise or consist of any number of different connectors capable of securing the housing to the main body in either a permanent or removable manner.

Figure 3:
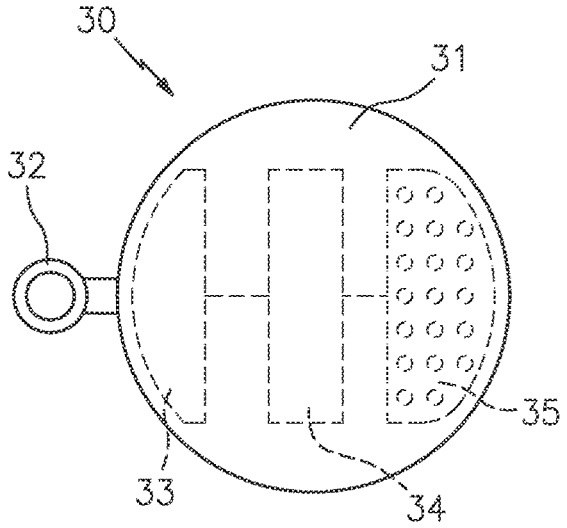
FIG. 3 is a top view of an audible charm of the illuminated bracelet, in accordance with one embodiment of the invention.

FIG. 3 illustrates one embodiment of an audible charm 30 that includes a housing 31, attachment ring 32, an internally located power source 33, a switch 34, and a speaker 35.

As described herein, the housing 31 and attachment ring 32 can include substantially identical components as the housing 21 and attachment ring 22, respectively; therefore, the above description applies to these elements as well.

The power source 33 can function to supply the necessary power requirements to the speaker 35 when selectively engaged by the switch 34. In the preferred embodiment, the power source can include one or more batteries that are in electrical communication with the switch and speaker.

The switch 34 can include any number of different components capable of detecting movement, inertia and/or acceleration caused by movement of the charm itself. In the preferred embodiment, the switch can include, comprise or consist of a commercially available centrifugal switch that can isolate the battery when no centrifugal force is detected, and can connect the battery to the speaker when a centrifugal force is detected. Once example of a centrifugal switch suitable for use herein is described in U.S. Pat. No. 5,839,814 to Roberts, the contents of which are incorporated herein by reference.

The speaker 35 can include any number, or type of sound producing devices. The speaker can function in a conventional manner to play an audible sound such as an alarm tone, for example, that is stored in an onboard memory of the speaker upon receiving power from the power source.

Figure 4:
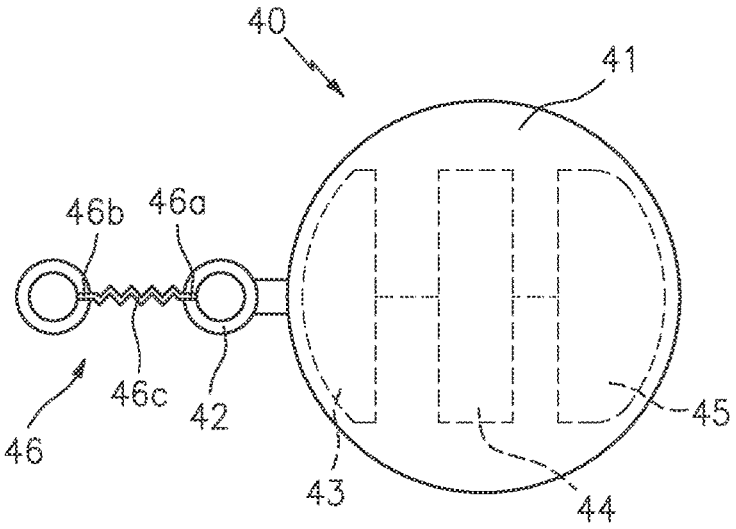
FIG. 4 is a top view of an illuminated charm of the illuminated bracelet, in accordance with one embodiment of the invention.

FIG. 4, illustrates one embodiment of an illuminated charm 40 that includes a housing 41 having an attachment ring 42, an internally located power source 43, a switch 44 and a light 45.

As described herein, the housing 41, attachment ring 42, power source 43 and switch 44 can include substantially identical components as the housing 21, attachment ring 22, power source 33 and switch 34, respectively; therefore, the above description applies to these elements as well.

The light 45 can preferably include, comprise or consist of one or more light emitting diodes (LED), for example, that are disposed inside the main body 21. In the preferred embodiment, the housing 41 will be translucent so as to allow the light produced from the LED to illuminate the main body itself, and to radiate outward. In another embodiment, however, the light can be positioned along an exterior portion of the main body. Of course, the light is not limited to the use of an LED, as any number or type of other light producing components are also contemplated.

In either instance, the light 45 can be connected to the power source 43 through the centrifugal switch 44 so as to be activated only when the device is spinning.

In one embodiment, one or more of the illuminated charms 40 can also include a resilient tether 46 that can function to secure the charm housing 41 to the main body 11 in a manner that allows the distance between the charm and the main body to expand when the device is spinning, and to contract when the device is not spinning (See FIG. 5).

As shown, the tether 46 can include a first end 46*a* that is coupled to the attachment ring 42, a second end 46*b* having a ring or other such component for mating with the main body 11 in the manner described above, and a resilient middle portion 46*c*. In the preferred embodiment, the resilient tether can include, comprise or consist of a helical extension spring or an elastomeric tether, for example that are capable of expanding and contracting as described herein.

Figure 5A:
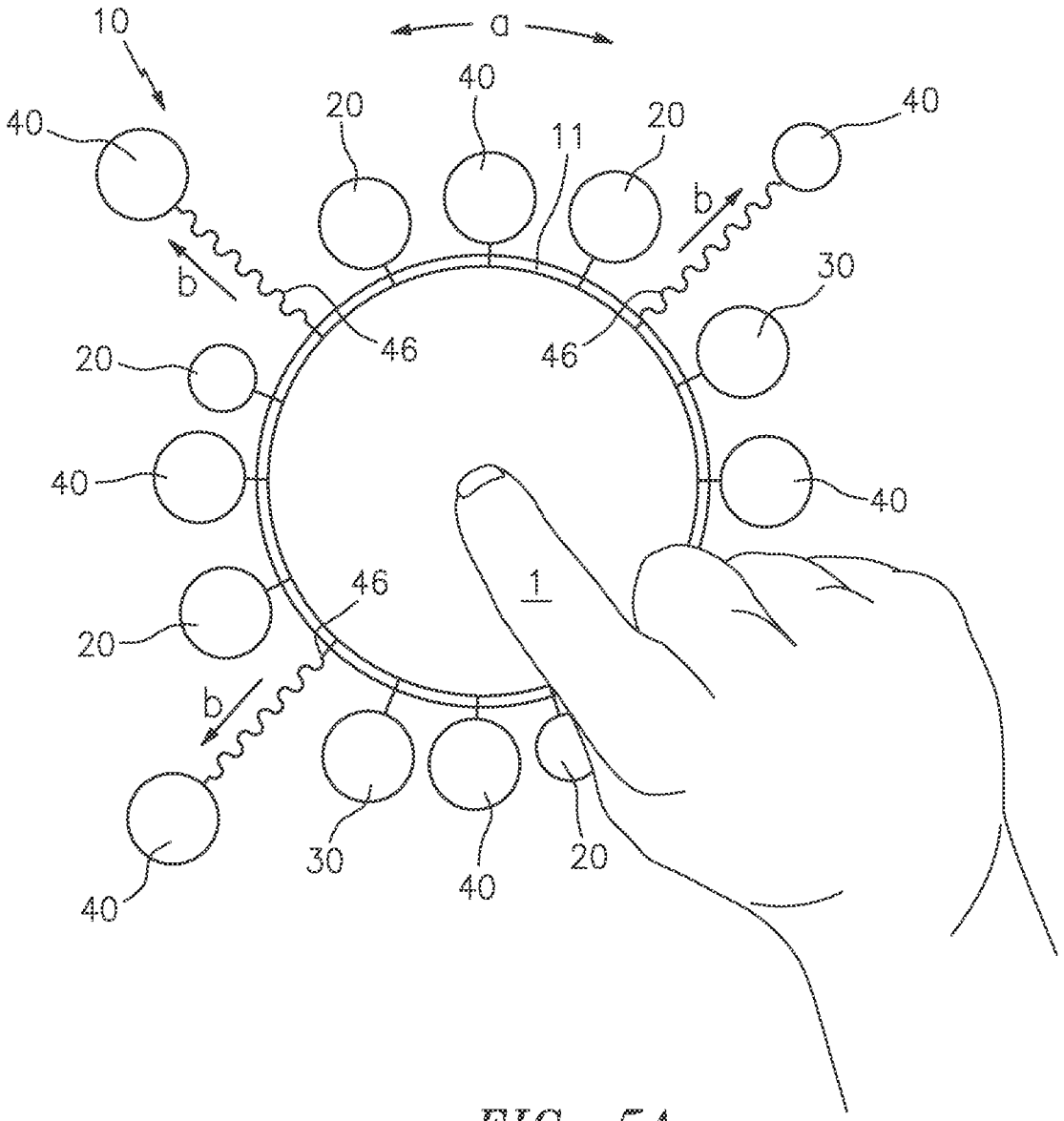
FIG. 5A is a perspective view of the illuminated bracelet in operation, in accordance with one embodiment of the invention.
Figure 5B:
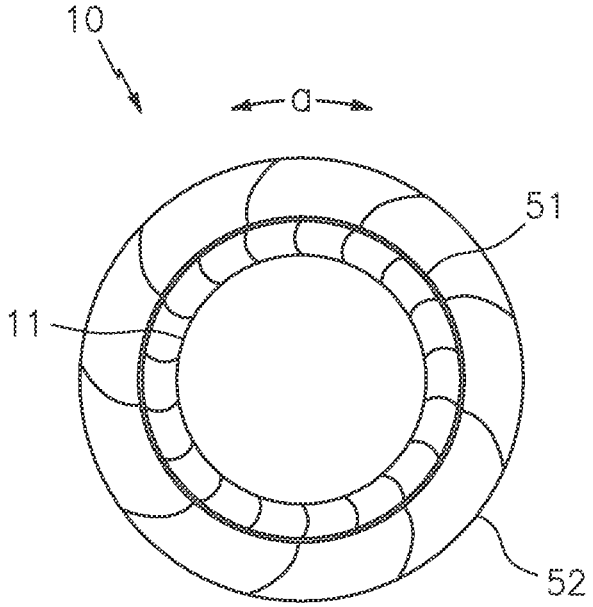
FIG. 5B is a top view of the illuminated bracelet in operation, in accordance with one embodiment of the invention.

FIGS. 5A and 5B illustrate one embodiment of the device in operation. As shown, a user can position their finger 1 along the inside facing portion of the main body 11 and begin spinning the device in either a clockwise or counter-clockwise position shown by arrow a. At this time, the centrifugal force of the device spinning along the users' finger can trigger the internal switches 34 and 44 to activate the speaker 35 and lights 45, thereby creating a ring of light 51.

Additionally, as the user continues to spin the device, the centrifugal force can function to expand the tethers 46 (see arrow b), thereby causing each of the lighted charms that are connected to a resilient tether to extend away from the main body, thus creating a second ring of light 51.

Accordingly, the above described illuminated bracelet device 10 can provide hours of entertainment to children of all ages and can be worn about the arm or wrist of the user when not in active operation, thus reducing the risk of loss and providing a fashion accessory.

As described herein, one or more elements of the device 10 can be secured together utilizing any number of known attachments means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined, with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A bracelet, comprising:

a circular shaped main body having an inside diameter that is configured to receive a human wrist; and a plurality of illuminating charms that are positioned equidistantly along the main body, wherein each of the plurality of illuminating charms are selectively activated by a centrifugal force associated with a rotation of the bracelet.

2. The bracelet of claim 1, wherein each of the plurality of illuminating charms include a charm housing, an attachment ring, a power source, a switch and a light.

3. The bracelet of claim 2, wherein the charm housing is constructed from a translucent material and the light is positioned inside the charm housing.

4. The bracelet of claim 2, wherein the switch comprises a centrifugal switch that is in electrical communication with the power source and the light.

5. The bracelet of claim 4, wherein the centrifugal switch is configured to supply power from the power source to the light only when the switch detects the centrifugal force.

6. The bracelet of claim 1, further comprising:

a plurality of decorative charms that are positioned along the main body.

7. The bracelet of claim 6, wherein each of the plurality of decorative charms includes a charm housing, an attachment ring, and a decorative element that is disposed along the charm housing.

8. The bracelet of claim 7, wherein each of the plurality of decorative charms are positioned equidistantly along the main body, and include a central mass having a weight that is complementary to a weight of a power source, a switch and a light of one of the plurality of illuminating charms.

9. The bracelet of claim 1, further comprising:

a plurality of audible charms that are positioned along the main body.

10. The bracelet of claim 9, wherein each of the plurality of audible charms include a charm housing, an attachment ring, a power source, a switch and a speaker.

11. The bracelet of claim 10, wherein the switch comprises a centrifugal switch that is in electrical communication with the power source and the speaker.

12. The bracelet of claim 11, wherein the centrifugal switch is configured to supply power from the power source to the speaker only when the switch detects the centrifugal force.

13. The bracelet of claim 1, wherein the main body is constructed from a rigid material and is configured to maintain a circular shape when spinning.

14. The bracelet of claim 1, wherein the main body is constructed from an elastomeric material and is configured to change shapes when spinning.

15. A bracelet, comprising:

a circular shaped main body having an inside diameter that is configured to receive a human wrist;

a plurality of illuminating charms that are positioned equidistantly along the main body;

a plurality of decorative charms that are positioned equidistantly along the main body; and at least one audible charm that is positioned along the main body, wherein each of the plurality of illuminating charms are selectively activated by a centrifugal force associated with a rotation of the bracelet, and the at least one audible charm is selectively activated by the centrifugal force associated with the rotation of the bracelet.

* * * * *